US006142799A

United States Patent [19]

Marcel

[11] Patent Number: 6,142,799

[45] Date of Patent: Nov. 7, 2000

[54] ELECTRICAL PLUG CONNECTION

[75] Inventor: Perle Marcel, Feldkirch, Austria

[73] Assignee: Hirschmann Austria GmbH, Rankweil, Austria

[21] Appl. No.: 09/432,481

[22] Filed: Nov. 1, 1999

[30] Foreign Application Priority Data

Nov. 3, 1998 [DE] Germany ..... 198 50 521

[51] Int. Cl.[7] ..... H01R 13/62

[52] U.S. Cl. ..... 439/152; 439/352; 439/370

[58] Field of Search ..... 439/152, 153, 439/154, 155, 157, 160, 370, 352, 372

[56] References Cited

U.S. PATENT DOCUMENTS

| | | | |
|---|---|---|---|
| 3,753,582 | 8/1973 | Graham . | |
| 4,865,554 | 9/1989 | Matsuoka et al. | 439/152 |
| 5,025,682 | 6/1991 | McCabe et al. . | |
| 6,036,524 | 3/2000 | Suzuki et al. | 439/156 |

FOREIGN PATENT DOCUMENTS

| | | | |
|---|---|---|---|
| 0622869 | 11/1994 | European Pat. Off. | 439/152 |
| 0727850 | 8/1996 | European Pat. Off. . | |
| 3515175 | 11/1986 | Georgia | 439/152 |
| 3725261 | 2/1989 | Georgia | 439/370 |
| 195 04 821 C2 | 12/1996 | Germany . | |
| 298 15 166 U1 | 12/1998 | Germany . | |
| 197 54 166 A1 | 6/1999 | Germany . | |
| 10189145 | 7/1998 | Japan . | |

*Primary Examiner*—Paula A. Bradley
*Assistant Examiner*—Tho D. Ta
*Attorney, Agent, or Firm*—Friedrich Kueffner

[57] ABSTRACT

An electrical plug connection has a first plug part having first contact elements and a second plug part having second contact elements. The plug parts being moved in a common plane toward one another until a contact position is reached in which the contact elements establish electrical contact with one another. A wire spring is mounted on the second plug part and has at least one spring leg that is moved from an initial position by the movement of the first plug part relative to the second plug part into a locking position in which the spring leg locks the first plug part and the second plug part in the contact position. The spring leg is a freely projecting spring wire and has a free end. The second plug part has a guide member for the free end of the freely projecting spring wire. The guide member is comprised of a first portion extending parallel to the moving direction and a slanted second portion slanted outwardly away from the second plug part. The free end of the spring leg rests slidably against the guide member so that, when the spring leg is moved by the movement of the first plug part relative to the second plug part, the free end of the spring leg moves in a parallel plane extending parallel to the common plane when sliding on the first portion and moves in a direction extending obliquely to the parallel plane when sliding on the slanted second portion. The spring leg is returned into the initial position when its free end has reached the end of the slanted second portion, wherein the initial position now corresponds to the locking position.

13 Claims, 4 Drawing Sheets

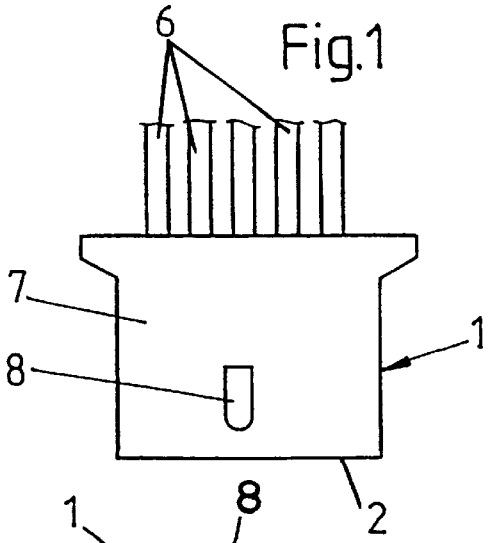
Fig.1
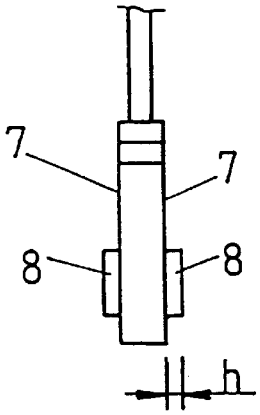
Fig. 2
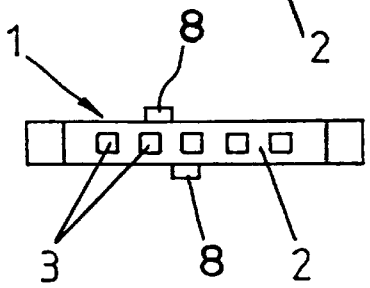
Fig. 4
Fig. 3
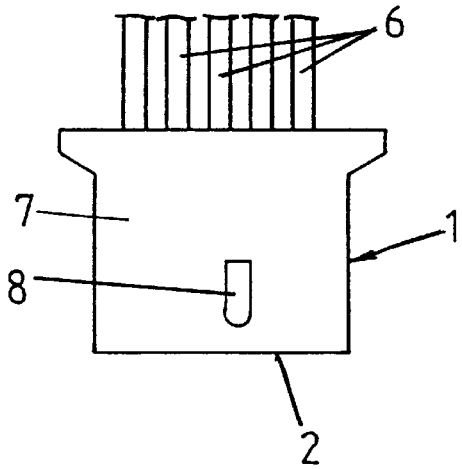
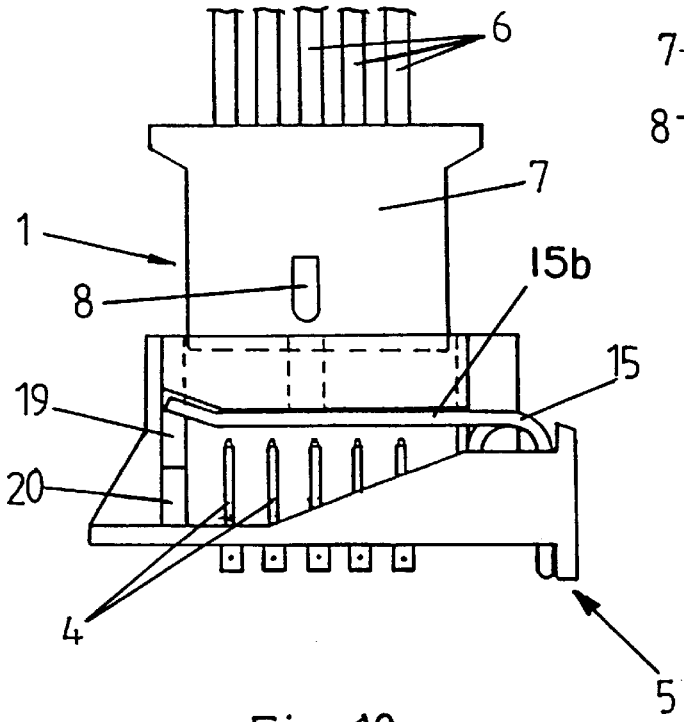
Fig. 10

ELECTRICAL PLUG CONNECTION

BACKGROUND OF THE INVENTION

1. Field of the Invention

The present invention relates to an electrical plug connection including a first plug part having arranged thereat contact elements connectable to electrical lines and of a second plug part with contact elements corresponding to the contact elements of the first part in regard to arrangement and configuration whereby these contact elements are, for example, contact pins and/or contact sockets. When the plug connection is completed, the contact elements rest against one another so as to establish electrical contact, and the two plug parts are locked against accidental or arbitrary separation. A wire spring is supported at one of the plug parts to provide a locking function for the two plug parts. It has at least one spring leg that is deflected by the relative movement of the two plug parts toward one another required for producing the electrical plug connection. The spring leg is deflected in the plane parallel to the moving direction of the parts for producing the plug connection as well as transverse to that plane.

2. Description of the Related Art

Plug connections for different applications are known in which the parts to be connected to one another can be locked relative to one another by a spring catch. Without claiming to provide a complete review, reference is made to the known device for securing an electrical or electronic component at a housing according to European patent document 0 727 850 A, respectively, the substantially identical disclosure of German patent document 195 04 821 C2; the securing holder for a solenoid coil according to U.S. Pat. No. 5,025,682; or the connecting coupling according to U.S. Pat. No. 3,753,582. The springs used in these devices are deflected transversely to the direction in which the parts to be connected are moved for producing the desired plug connection. When the parts to be connected are completely inserted, the transversely deflected spring engages a groove and thus forms a locking bolt arrangement which prevents accidental or arbitrary separation of the connected parts. When the parts to be connected are not completely inserted, the connection is not only insufficient but, moreover, the spring cannot perform the desired locking function. In electrical plug connections that are to be used in monitoring circuits and can no longer be accessed or accessed only with difficulty after their installation in a device, an incomplete connection may result in disastrous consequences.

From Japanese patent document 10-189145 A another electrical plug connection is known in which the plug parts automatically separate if the parts forming the plug connection have been incompletely inserted into one another, i.e., without producing optimal contacting, and the plug connection is not locked. For this purpose a U-shaped wire spring is provided having two lateral legs with additional S-shaped and compressible portions. Upon insertion of the two parts of the plug connection, the two lateral legs as well as the base leg connecting the two lateral legs are compressed. Subsequently, the forward arc-shaped end of the U-shaped spring is upwardly deflected and lifted above the abutment surface at the other plug part which compresses the U-shaped spring. The compression of the U-shaped spring is thus released and the spring can move into its locking position in which it engages behind a projection at the other plug part. The disadvantage of this plug connection is that the plug is relative large with respect to its height and its axial longitudinal extension. A size reduction of the plug connection in the axial direction has limits especially because of the space requirements of the U-shaped spring which must be provided with a sufficient compressibility in the axial direction. However, for certain applications, the space that is available for a plug is very limited.

SUMMARY OF THE INVENTION

It is an object of the present invention to provide a plug connection of the aforementioned kind which has a minimal height and minimal extension in the axial direction.

In accordance with the present invention, this is achieved in that the spring leg is formed by a freely projecting spring wire having a free end resting against a guide member of the plug part accommodating the wire spring. Upon deflection of the spring leg resulting from the movement of the two parts toward one another for producing the plug connection, the free end is moved along this guide member. The guide member has a first portion extending parallel to the direction of movement of the two parts and a second portion positioned adjacent to the first portion and having an outwardly slanted wedge shape.

The freely projecting spring wire allows a relatively wide deflection in the axial direction of the plug connection while allowing simultaneously a minimal extension of the spring itself in the axial direction. Because of the use of the freely projecting spring wire in connection with a guide member, the plug connection has a minimal total height. The plug connection is further characterized by a simple design.

BRIEF DESCRIPTION OF THE DRAWING

In the drawing:

FIG. 1 is a plan view of the first plug part provided with contact sockets of the plug connection according to the invention;

FIG. 2 is a side view of the plug part of FIG. 1;

FIG. 3 is an end view of the plug part of FIG. 1;

FIG. 4 is a bottom view of the plug part of FIG. 1;

FIG. 10 shows the relative position of the two plug parts of the plug connection at the beginning of insertion;

DESCRIPTION OF THE PREFERRED EMBODIMENTS

Figure 8:
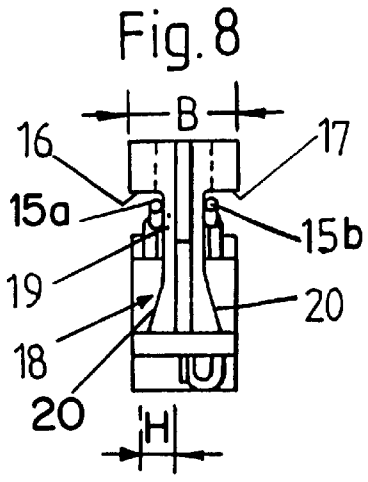
FIG. 8 is a side view of the plug part of FIG. 5 in the direction of arrow VIII.
Figure 6:
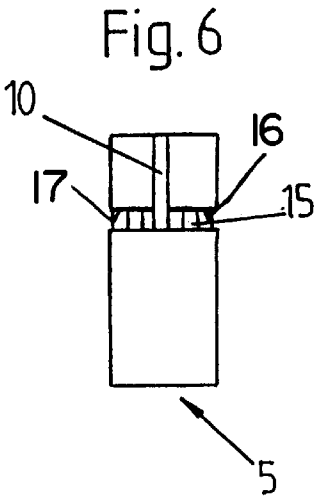
FIG. 6 is a side view of the plug part of FIG. 5 in the direction of arrow VI of FIG. 7.
Figure 7:
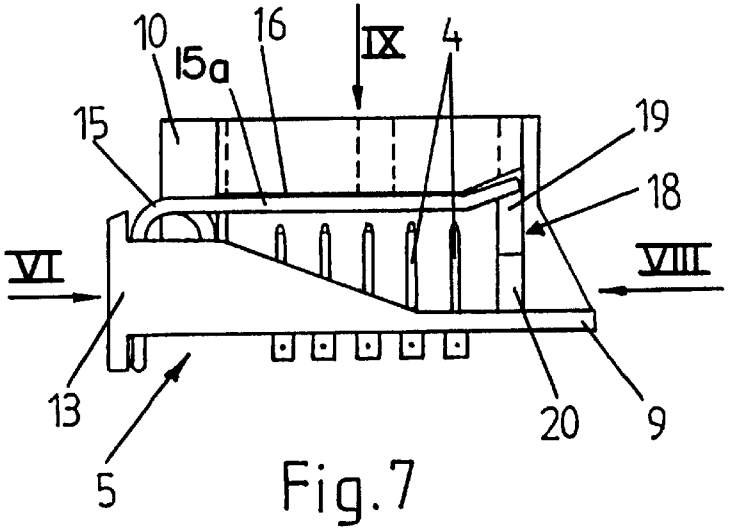
FIG. 7 is a bottom view of the plug part of FIG. 5.
Figure 5:
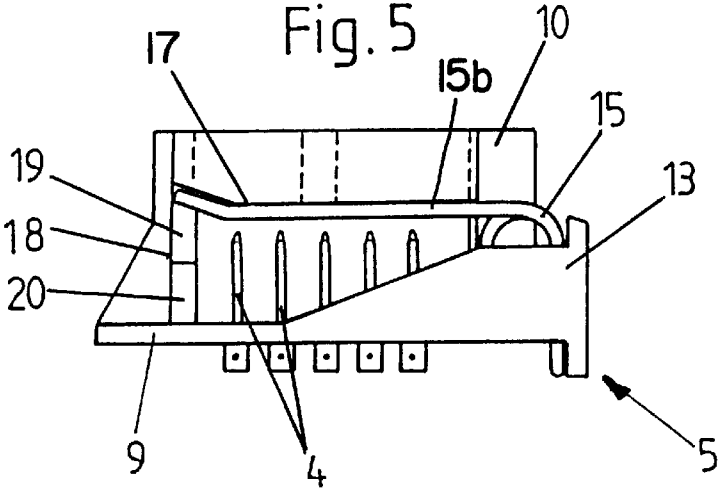
FIG. 5 is a plan view of the second plug part of the plug connection according to the invention.
Figure 9:
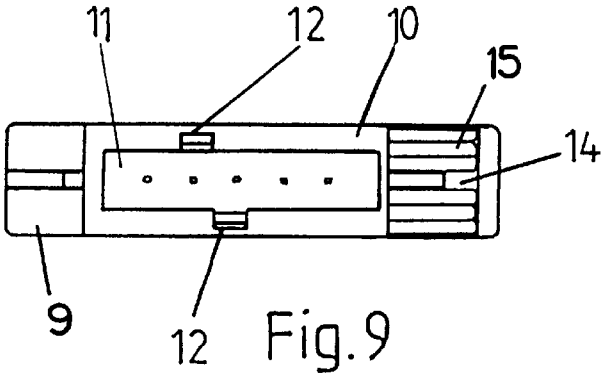
FIG. 9 is an end view of the plug part of FIG. 5 in the direction of arrow IX.
Figure 12:
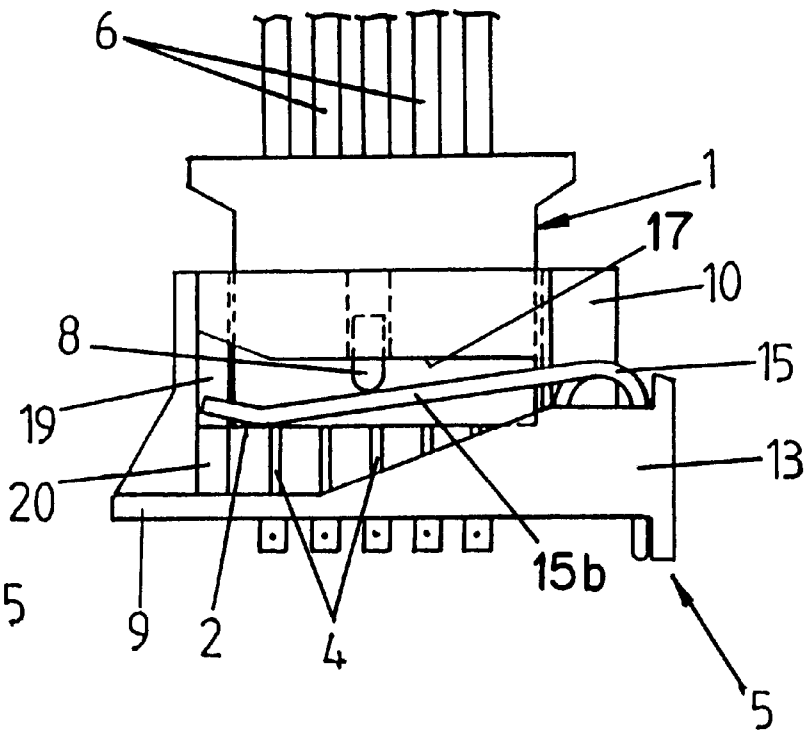
FIG. 12 shows the relative position of the two plug parts of the plug connection upon further insertion, with the follower pushing the spring leg downwardly.

The first plug part 1, comprising contact elements in the form of contact sockets (not shown), of the plug connection according to the invention is embodied as a flat, epipedal member having a narrow end face 2 with openings 3 for receiving contact pins 4 of the second plug part 5 of the plug connection. Electrical lines 6 are connected to the non-represented contact elements (sockets) of the plug part 1. The wide lateral surfaces 7 of the first plug part 1 has projections or cams which serve as followers 8.

The second plug part 5 of the plug connection has a base 9 in which the contact pins 4 are secured and arranged within a common plane. This base 9 is part of a peripherally closed frame having a frame leg 10 positioned opposite the base 9. The frame leg 10 has a cutout 11 that matches the cross-section of the first plug part 1 with respect to its size and circumferential contour. This cross-section of the first plug part 1 is defined relative to the plane which contains the followers 8. These followers 8 at the first plug part 1 are arranged off-center in order to ensure in this manner that the two plug parts 1 and 5 can be inserted into one another only in a predefined relative position (coding). The aforementioned cutout 11 of the frame leg 10 of the peripherally closed frame has grooves 12 for receiving the followers 8. These grooves 12 extend over the entire height of the frame leg 10. The two lateral legs 13 and 18 complete the peripherally closed frame. The lateral leg 13 has an upwardly open pocket 14 in which the windings of the wire spring 15 are mounted. The wire spring 15 has two freely projecting wire legs 15*a*, 15*b*. These spring legs 15*a*, 15*b* extend transversely across the second plug part 5 and rest with their free ends at the other lateral leg 18 of the peripherally closed frame. The lateral leg 18 is a guide member for the free ends of the two spring legs 15*a*, 15*b* of the wire spring 15. This guide member has a first upper portion 19 which extends parallel to the relative moving direction of the two plug parts 1 and 5 of the plug connection and a slanted second portion 20 adjacent thereto which is wedge-shaped. The lateral deflection H of the wedge slant of the second slanted portion 20 (FIG. 8) is greater than the height h of the follower 8 of the plug part 1. The width B of the upper frame leg 10 having the cutout 11 is dimensioned such that the spring legs 15*a*, 15*b* of the wire spring 15 rest pretensioned against the undercut surfaces 16, 17 of the upper frame leg 10. Like the contact elements of the plug part 1, the contact elements in the form of contact pins 4 can also be connected to electrical lines. The spring legs 15*a*, 15*b* of the wire spring 15 are shaped and designed such that they rest pretensioned against the undercut surfaces 16, 17 of the upper frame leg 10 having the cutout 11 as well as against the lateral leg 18 which serves as a guide member for the free ends of the spring legs 15*a*, 15*b*.

This concludes the description of the individual plug parts 1 and 5 of the plug connection. FIGS. 10 through 14 show the individual steps for producing the plug connection, for which purpose the two plug parts 1, 5 are positioned in a common plane. FIG. 10 illustrates the insertion of the plug part 1 into the cutout 11 of the plug part 5. The followers 8 are still positioned externally to the upper frame leg 10. Subsequently, the followers 8 are inserted into the grooves 12 of the cutout 11. The leading end face of the followers 8 in the insertion direction now contact the respective spring leg 15*a* or 15*b* of the wire spring 15 (FIG. 11) because these spring legs 15*a*, 15*b* project into the cross-sectional openings of the grooves 12. Upon further insertion of the plug part 1 (FIGS. 12 and 13), the leading end faces of the followers 8 now press against the spring legs 15*a*, 15*b* of the wire spring 15 and force them downwardly. The spring legs 15*a*, 15*b* of the wire spring 15 move initially downwardly in a plane that is parallel to the moving direction of the two plug parts 1 and 5 while sliding along the, upper portion 19 of the lateral leg 18 embodied as a guide-member. As soon as the ends of the spring legs 15*a*, 15*b* of the wire spring 15 reach the area of the slant of the wedge-shaped second portion 20 (FIG. 13), the spring legs 15*a*, 15*b* of the wire spring 15 are not only forced downwardly but also transversely and outwardly, i.e., they are moved obliquely to the moving direction of the two plug parts 1, 5, respectively to the parallel plane mentioned above. Upon further insertion of the plug parts 1 and 5, the spring legs 15*a*, 15*b* of the wire spring 15 are finally subjected to a transverse deflection at the lower end of the wedge-shaped slanted portion 20 which is greater than the height h of the followers 8 so that the pretensioned spring legs 15*a*, 15*b* of the wire spring 15 will suddenly return in the upward direction. They again rest at the undercut surfaces 16, 17 of the upper frame leg 10 of the plug part 5 and engage behind the followers 8 (FIG. 14), i.e., the spring legs 15*a*, 15*b* have now reached their locking position. In this position of the plug parts 1 and 5, optimal contacting of the plug connection is realized. Moreover, the plug connection is now locked.

Figure 11:
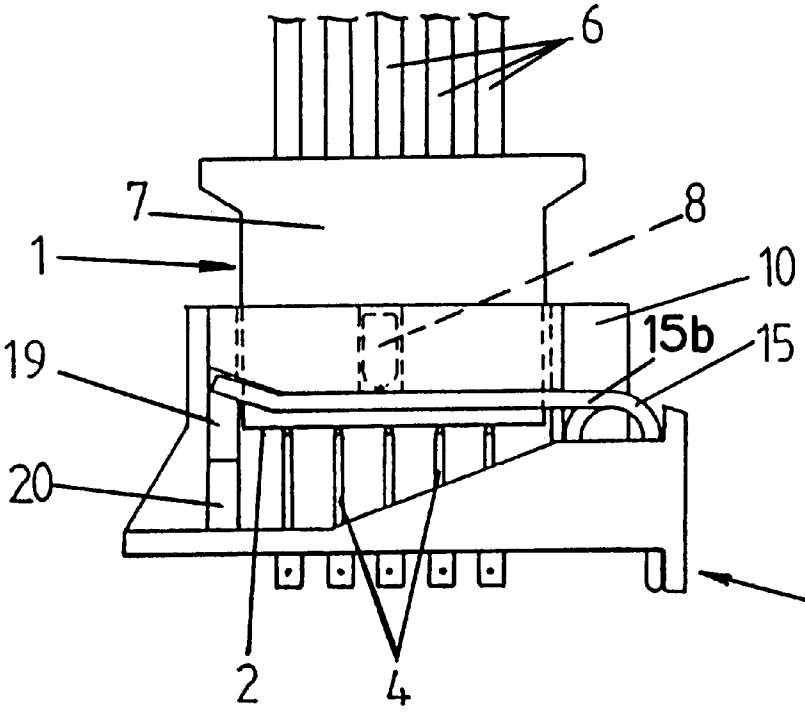
FIG. 11 shows the relative position of the two plug parts of the plug connection with the follower received in the groove of the upper frame leg of the second plug part.
Figure 14:
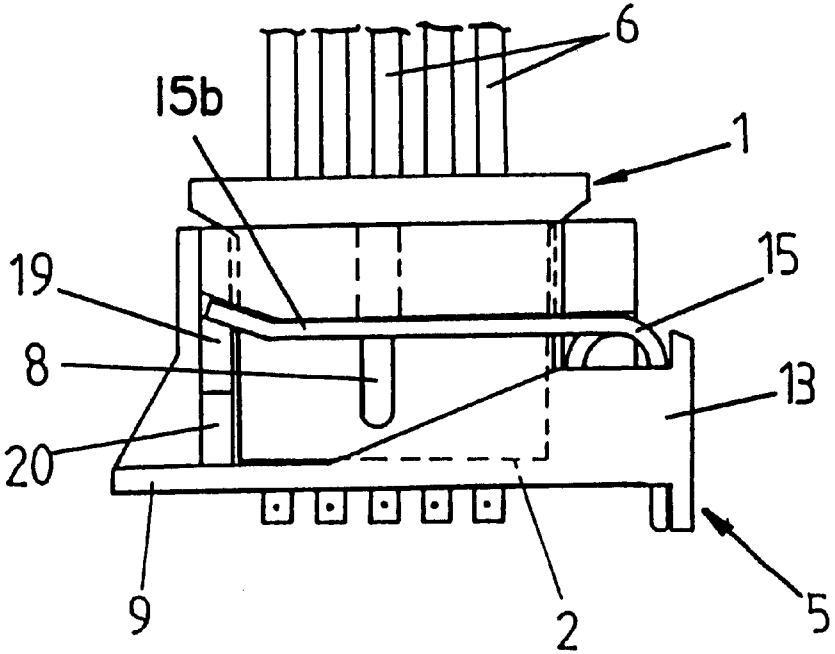
FIG. 14 shows the two plug parts of the plug connection upon completed insertion with the spring leg in the locking position.
Figure 13:
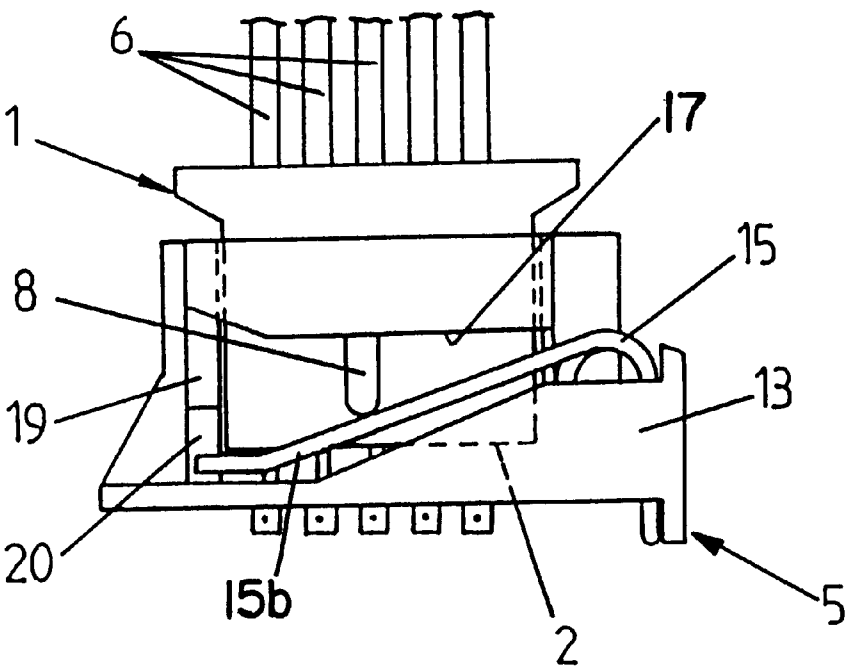
FIG. 13 shows the relative position of the two plug parts of the plug connection upon further insertion, with the follower having forced the spring leg to the end of the slanted portion of the guide member.

When during manufacture of the plug connection the pushing force acting onto the plug parts 1 and 5 ceases before locking has been achieved, the force exerted by the spring legs 15*a*, 15*b* of the wire spring 15 on the followers 8 is sufficient to separate the plug parts 1 and 5 from one another (compare FIG. 11). This spring action reliably prevents chance contacting. The locking via the spring legs 15*a*, 15*b* of the wire spring 15 and the followers 8 of the first plug part 1 of the plug connection is designed such that it can be released only with relatively great force expenditure. Plug connections of this kind are called go-nogo plug connections. The described and illustrated plug connection according to the invention can be used successfully also where the two plug parts 1 and 5 of the plug connection have other cross-sectional shapes as the one disclosed. Such cross-sections can be round shapes or polygonal shapes. It is only important that the pretensioned spring exerts the counter force onto the two plug parts to be connected until optimal contacting is realized. Until this optimal contacting is ensured, the pre-stressed spring has the task to separate the plug parts from one another. When optimal contacting is achieved, the spring has the additional function of locking the connected parts relative to one another in order to thus prevent an accidental separation of the parts. Depending on the configuration and pre-stress of the wire spring (15), the expenditure for unlocking and release of the plug connection varies. The wire spring can be designed and pretensioned, for example, such that the plug connection can be unlocked and released only with tools but also such that no tools are required for unlocking and releasing the plug connection.

While specific embodiments of the invention have been shown and described in detail to illustrate the inventive principles, it will be understood that the invention may be embodied otherwise without departing from such principles.

What is claimed is:

1. An electrical plug connection comprising:

a first plug part having first contact elements;

a second plug part having second contact elements configured to correspond to the first contact elements, wherein the first and second plug parts are combined to form the electrical plug connection by being moved in a common plane in a moving direction toward one another until a contact position is reached in which the first and second contact elements establish electrical contact with one another;

a wire spring mounted on said second plug part and having at least one spring leg;

the at least one spring leg being moved from an initial position by the movement of the first plug part relative to the second plug part into a locking position in which the spring leg locks the first plug part and the second plug part in the contact position;

the at least one spring leg being a freely projecting spring wire and having a free end;

the second plug part having a guide member for the free end of the at least one spring leg, the guide member being comprised of a first portion extending parallel to the moving direction and a slanted second portion slanted outwardly away from the second plug part;

the free end of the at least one spring leg slidably resting against the guide member so that, when the at least one spring leg is moved by the movement of the first plug part relative to the second plug part, the free end of the at least one spring leg moves in a parallel plane extending parallel to the common plane when sliding on the first portion and moves in a direction extending obliquely to the parallel plane when sliding on the slanted second portion;

the at least one spring leg being configured to be returned into the initial position when the free end of the at least one spring leg has reached an end of the slanted second portion, wherein the initial position now corresponds to the locking position.

2. The electrical plug connection according to claim 1, wherein the first and second contact elements are contact pins and matching contact sockets.

3. The electrical plug connection according to claim 1, wherein the wire spring has a portion comprised of multiple windings, the freely projecting spring wire extends from one end of the multiple windings, and the second plug part has a pocket for receiving the multiple windings of the wire spring.

4. The electrical plug connection according claim 1, wherein the first portion of the guide member is longer than the slanted second portion of the guide member.

5. The electrical plug connection according to claim 1, wherein the first plug part has an exterior surface provided with at least one follower and wherein the at least one spring leg is positioned in a travel path of the at least one follower when the first plug part is inserted into the second plug part.

6. The electrical plug connection according to claim 5, the at least one follower being a projection or cam.

7. The electrical plug connection according to claim 5, wherein the at least one follower has a height measured at a right angle to the exterior surface of the first plug part and wherein the height of the at least one follower is smaller than a deflection of the at least one spring leg in a direction perpendicularly to the parallel plane.

8. The electrical plug connection according to claim 5, wherein, in the locking position, the at least one spring leg rests against an end face of the at least one follower facing away from the direction of insertion.

9. The electrical plug connection according to claim 5, wherein the second plug part has a base, a frame leg positioned opposite the base, a first lateral leg and a second lateral leg positioned opposite one another and connecting ends of the base and ends of the frame leg to one another to define a peripherally closed frame, wherein the contact elements of the second plug part are secured in the base and the frame leg has a cutout for receiving the first plug part, wherein the wire spring is supported on the first lateral leg, and wherein the second lateral leg defines the guide member.

10. The electrical plug connection according to claim 9, wherein the cutout is configured to match a contour of the first plug part viewed in the moving direction, wherein the frame leg has at least one groove, opening into the cutout and extending in the direction of insertion, for receiving the at least one follower of the first plug part, wherein the at least one spring leg projects into a cross-sectional opening of the groove, when viewed in the moving direction.

11. The electrical plug connection according to claim 9, wherein the frame leg is wider than the first and second lateral legs and has undercut surfaces facing the base, wherein one of the undercut surfaces provides a stop for the at least one spring leg.

12. The electrical plug connection according to claim 11, wherein the at least one spring leg rests pretensioned against the one undercut surface.

13. The electrical plug connection according to claim 11, wherein the wire spring has two of the spring legs extending substantially parallel to one another and wherein each one of the spring legs rests pretensioned against opposite exterior sides of the second plug part.

* * * * *